US005711706A

United States Patent [19]

Griffin et al.

[11] Patent Number: 5,711,706

[45] Date of Patent: Jan. 27, 1998

[54] ACCESS DOOR WITH A DOUBLE SEAL

[75] Inventors: Charles K. Griffin, Conway; Ken Jurgensmeyer, Maumelle, both of Ark.; Paul R. Rogers, Hixson, Tenn.

[73] Assignee: Carrier Corporation, Syracuse, N.Y.

[21] Appl. No.: 671,969

[22] Filed: Jun. 28, 1996

[51] Int. Cl.[6] ..... E06B 7/14

[52] U.S. Cl. ..... 454/338; 49/476.1; 49/484.1; 454/370

[58] Field of Search ..... 454/338, 355, 454/370; 49/475.1, 476.1, 483.1, 484.1

[56] References Cited

U.S. PATENT DOCUMENTS

| | | | |
|---|---|---|---|
| 1,492,840 | 5/1924 | Eveleth | 49/476.1 |
| 3,101,135 | 8/1963 | Neal et al. | 49/484.1 X |
| 3,810,331 | 5/1974 | McCurdy et al. | 49/484.1 X |
| 3,912,348 | 10/1975 | Seymour | 49/483.1 X |
| 4,572,240 | 2/1986 | Van Becelaere | 49/475 |
| 4,986,039 | 1/1991 | Weisner | 52/72 |

FOREIGN PATENT DOCUMENTS

| | | | |
|---|---|---|---|
| 1 959 247 | 5/1971 | Germany | 49/476.1 |
| 58-122239 | 7/1983 | Japan | 49/484.1 |
| 185620 | 8/1936 | Switzerland | 49/476.1 |
| 783376 | 9/1957 | United Kingdom | 49/476.1 |

*Primary Examiner*—Harold Joyce

[57] ABSTRACT

An access door to an air handler unit is provided, having a double seal set in the door frame. The double seal is composed of an outer seal which provides a moisture barrier, having an aperture to permit air to pass through, and an inner seal which provides an air barrier. The inner and outer seal are spaced apart to provide an air gap therebetween. A lip is provided along the side and top of the door to shed water away from the outer seal. The door is hingedly supported in the frame, where the outer surface of the door comes in sealing contact with the outer seal and the inner surface of the door comes in sealing contact with the inner seal when the door is closed. A set of door handles is provided to lock the seals in place when the door is closed and latched properly.

8 Claims, 3 Drawing Sheets

ACCESS DOOR WITH A DOUBLE SEAL

BACKGROUND OF THE INVENTION

1. Field of the Invention

This invention relates generally to heating and cooling systems, and specifically to access doors having a double seal for outdoor air-handling units.

2. Discussion of the Related Art

Access doors are provided for air handling units in order to service the interior of the unit without disassembly. There may be a number of doors on some units.

Access doors with conventional seals are troublesome in that the existing negative pressure on the inside of any such door tends to bring in moisture wherever there is leakage. This moisture may cause damage to the inside of the air handler by degrading the quality of the air passing through the system and causing unwanted corrosion of the air handling equipment. Additionally, the moisture may alter the performance of the air handling unit to undesirable levels.

Improved sealing mechanisms for such access doors incorporate a variety of seal structures to attempt to prevent water from entering the units. CESCO Products has manufactured a double seal which uses an outer and an inner seal, both being pressure seals. However, with this design, if the inner seal leaks, a negative pressure will exist between the two seals, which in turn would cause any outer seal leakage to bring in moisture.

Additionally the seal must be designed so that it is properly pressurized when the door is closed to retain the internal negative pressure.

Thus it is needed to design an access door having an airtight and watertight seal which may be tightly secured between the door and the air handling unit when the door is closed.

OBJECTS AND SUMMARY OF THE INVENTION

It is therefore a principal object of the present invention to improve air handling units.

It is also an object of the present invention to improve access doors on air handling units.

Another object of the present invention is to provide an improved seal mechanism for access doors on air handling units.

A further object of the present invention is to provide a double seal for access doors on air handlers to prevent water from entering the system.

Yet another object of the present invention is to control the pressure of the seals by adjusting the door handle.

These and other objects of the present invention are attained by an access door for an air handling unit having a double seal set in the door frame. The double seal is composed of an outer seal which provides a moisture barrier, having an aperture to permit air to pass through, and an inner seal which provides an air barrier. The inner and outer seal are spaced apart to provide an air gap therebetween. A lip is provided along the side and top of the door to shed water away from the outer seal. The door is hingedly supported in the frame, where the outer surface of the door comes in sealing contact with the outer seal and the inner surface of the door comes in sealing contact with the inner seal when the door is closed. A set of door handles is provided to lock the seals in place when the door is closed and latched properly.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
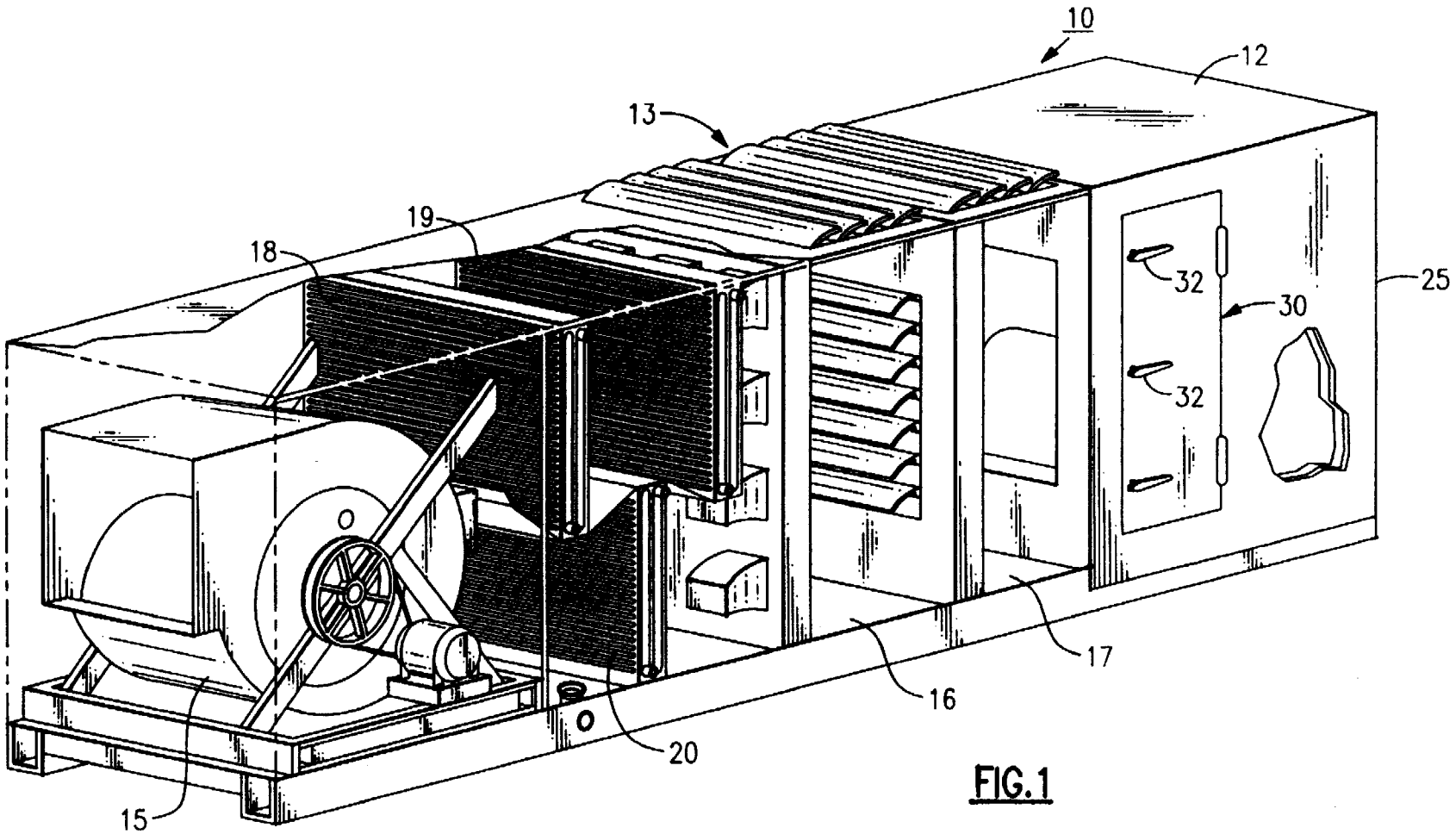
FIG. 1 is a side elevational view of an air-handling unit illustrating the access door embodying the teachings of the present invention.

Referring initially to FIG. 1, there is referenced generally an air-handler 10 to which this invention relates. The present unit can be mounted in any number of configurations to meet different air handling applications, however, it will be herein described as being employed as an air conditioning system for providing comfort air to a building. Return air from the comfort zone is initially brought into housing 12 via a return air fan and then enters an elongated air duct 13. Under the influence of supply air fan 15, the air is drawn through the duct where it is mixed with outside air in plenums 16 and 17. The air is then passed through a series of heat exchangers 18–20 where the air is either heated or cooled depending on the demand placed on the system. As illustrated, the heat exchangers can be stacked in vertical tiers one above the other and in horizontal rows one behind the other or in different combinations thereof depending on the particular air handling application.

At one end of the unit is a housing 25 having a side access door 30 for entry into the unit. The door includes a plurality of locking mechanisms 29 that include an exterior handle 32 and an interior handle 34. Various indicia may be placed on the exterior surface of the door such as warning and certification labels or the manufacturer's trademark.

Figure 2:
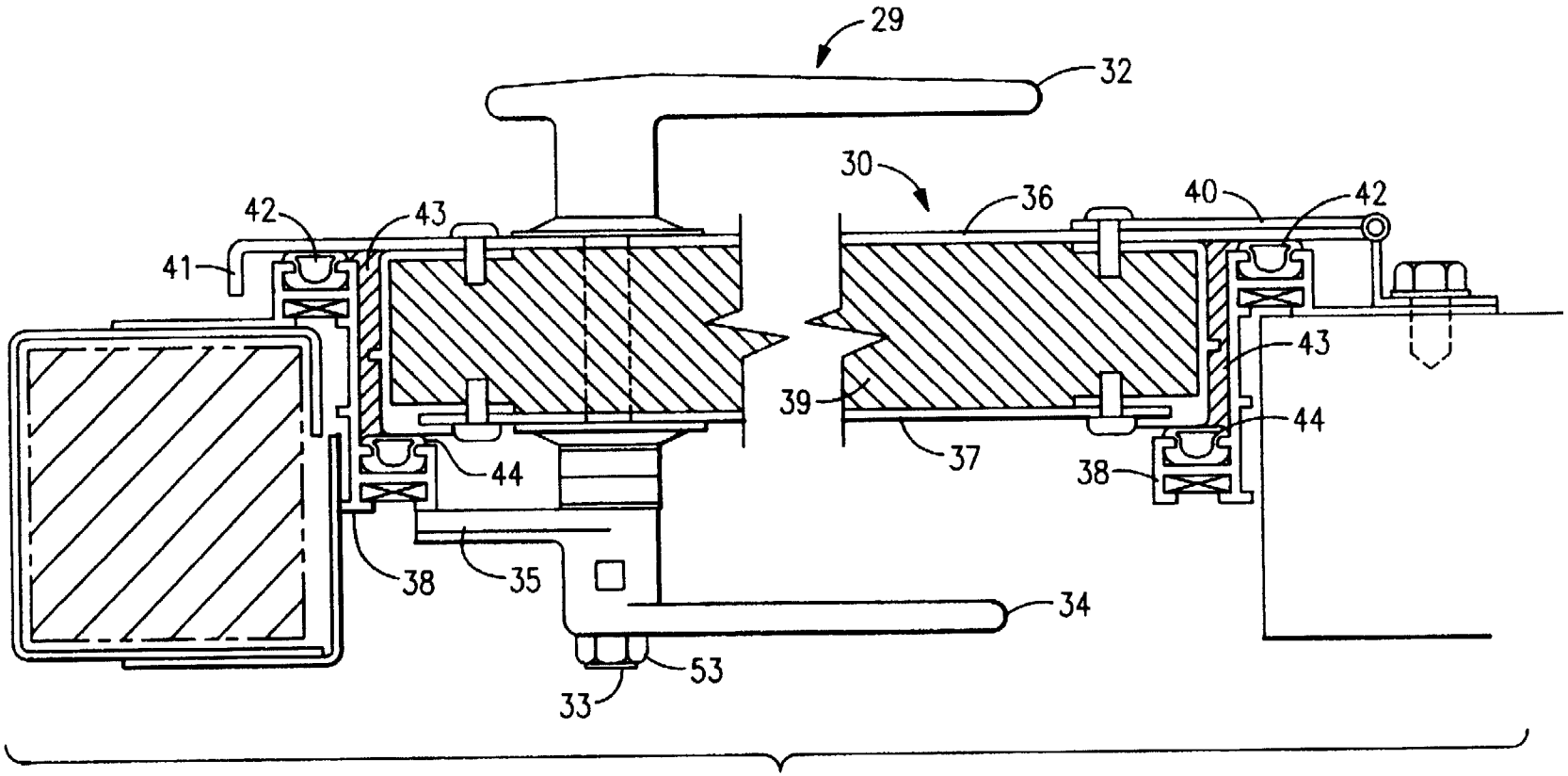
FIG. 2 is an enlarged partial top cross-sectional view showing the structure of the door illustrated in FIG. 1.

Referring now to FIG. 2, there is shown a cross-sectional top view of the door 30 and one of the locking mechanisms 29. Interior door handle 34 is coaxial with the exterior door handle through door 30, via bolt 33, with locking nut 53. The interior door handle has a locking lug 35 thereon in the opposite direction of the handle portion, to be used for latching, described in further detail subsequently. Three handles are shown on the door in FIG. 1, and the number of door handles may vary depending on the size of the door and the desired placement of the handles.

Door 30 is comprised of door panels 36 and 37 with insulation 39 therebetween. Door panel 36 is connected to the air handler unit via hinge 40, which allows for the door to open outwardly. The door is set in door frame 38, which is attached to the side of the cabinet containing the air duct.

Figure 3:
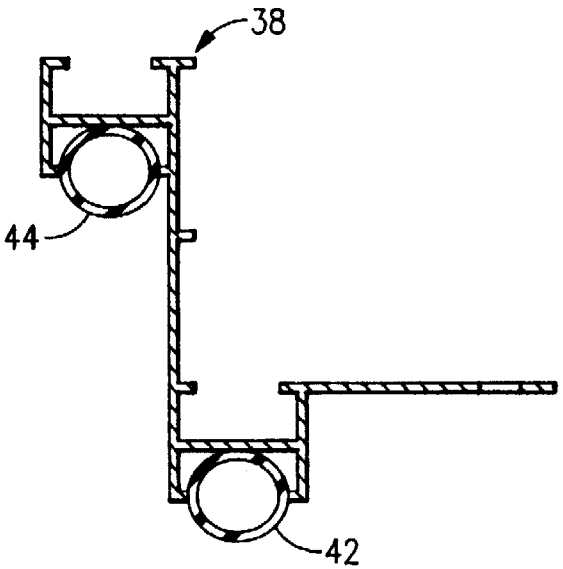
FIG. 3 is an enlarged top cross-sectional view of the door frame housing the seals.

Door frame 38 is illustrated in FIGS. 2 and 3 as housing the outer door seal 42 and the inner door seal 44. Both seals are preferably bulb-type and made of a relatively soft rubber-like material such as that supplied by the Shell Corporation under the trademark Kraton.

The outer door seal is supported by the door frame and when closed, abuts door panel 36 adjacent to hinge 40 on one end and adjacent to lip 41 on the other end. The lip is placed on the top of the door as well as the nonhinged side. The inwardly turned lip protects the outer seal by preventing water from reaching the outer seal's surface. When the door is closed, the hinge will force the door panel 36 against the outer seal 42, providing a watertight seal.

Similarly, the horizontal member of the door frame on the inner side of the door houses the inner door seal 44. The inner door seal 44 surrounds the door on all four sides and is supported by the door frame and abuts the door panel 37 when the door is closed. When the door is closed, the inner seal seals against the total static pressure difference. A space 43 between the two seals is at ambient pressure due to the aperture allowing air to pass through the outer seal. There is no pressure difference across the outer seal and thus no tendency for water to leak past the outer seal. Thus, if the inner seal were to ever leak, less harmful air may leak through, but as the outer seal is a watertight seal, no damaging water would leak through to the inside of the air duct.

The length of locking lug 35 of the interior door handle 34 is precisely selected to abut the door frame, and thus pressurizing the inner door seal. The handle pressurizes this seal when the door is closed and latched as shown in FIG. 2. A plurality of handles provides a more positive seal with more secure closure.

Figure 5:
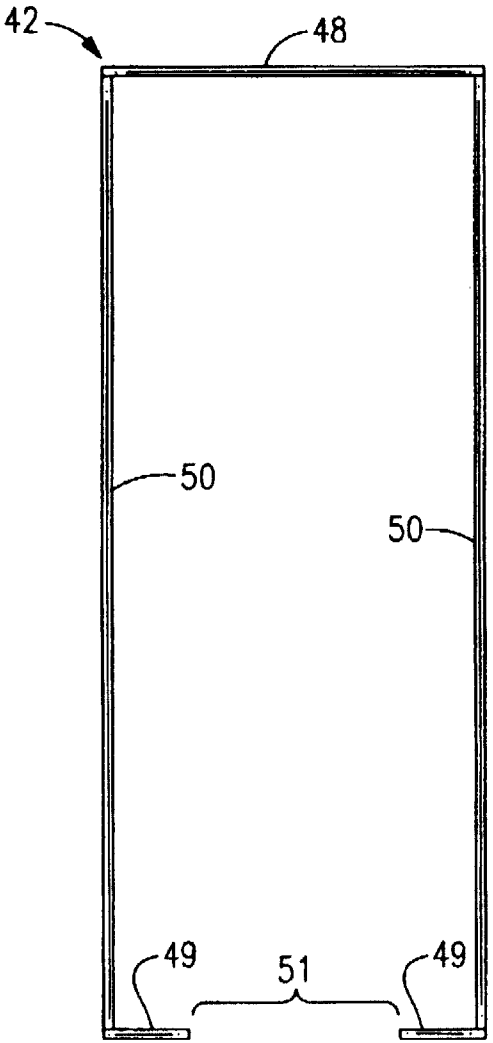
FIG. 5 is a front view of the outer seal with aperture.
Figure 4:
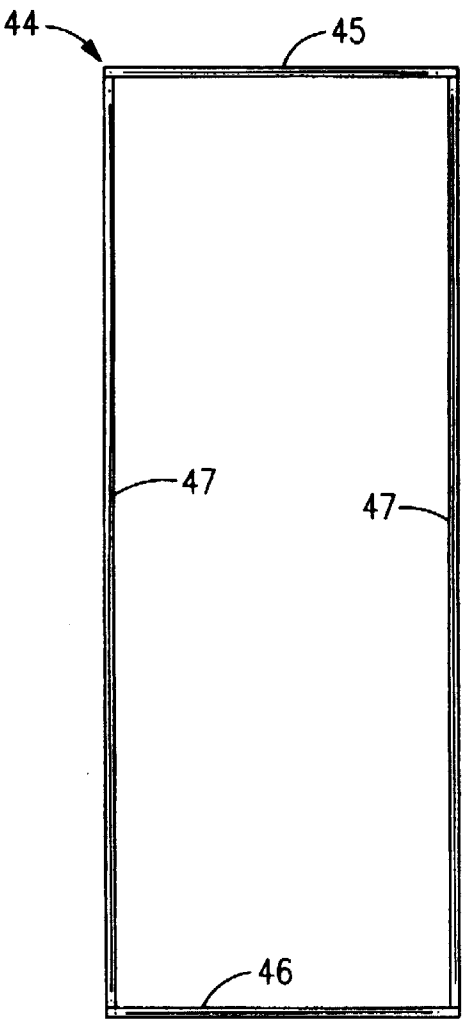
FIG. 4 is a front view of the inner seal.

FIG. 4 shows the inner door seal 44 extending around the entire perimeter of the door, having a top 45, bottom 46, and sides 47. FIG. 5 illustrates the outer door seal having top 48, bottom 49, and sides 50, the bottom having a gap 51 which allows air to pass through, thereby allowing the space between the inner door seal and the outer door seal to be at ambient. Preferably the aperture is embodied as a gap on the bottom of the door as illustrated, however, the aperture may be at any place on the outer seal where water may be prevented from entering through the aperture.

While this invention has been explained with reference to the structure disclosed herein, it is not confined to the details as set forth and this application is intended to cover any modifications and changes as may come within the scope of the following claims.

What is claimed is:

1. In an air handling apparatus having an enclosed duct through which air at a negative pressure is moved, an entry for gaining access to said duct that includes a door frame mounted in an opening in said duct, said frame including a first outer seal for providing a moisture barrier that surrounds the frame, said outer seal having an aperture therein to permit ambient air to pass therethrough, and a second inner seal for providing an air barrier that surrounds said frame, said seals having an air gap therebetween; and a door hingedly supported in said frame, said door having a first surface means for closing in sealing contact against said outer seal and a second surface means for closing in sealing contact against said inner seal when the door is closed against the frame whereby the air gap between the seals is maintained at ambient pressure when the door is at closure.

2. The apparatus of claim 1 wherein said frame is formed of a single piece of material.

3. The apparatus of claim 2 wherein said frame has a first recessed housing for containing the outer seal and a second recessed housing for containing the second seal.

4. The apparatus of claim 3 wherein said seals are bulb seals having internal air chambers whereby the seals deform against the door surfaces at closure.

5. The apparatus of claim 1 that further includes a latch means that is operable to secure the door against the frame at closure.

6. The apparatus of claim 5 wherein said latch means is a hand operated lever that is rotatably mounted in the door, said lever containing an arm that is capable of being rotated into locking engagement with the frame.

7. The apparatus of claim 1 wherein the frame is rectangular in form and the aperture in the outer seal is located along the bottom section of the frame.

8. The apparatus of claim 7 wherein the door further includes an outer panel containing said first surface means for closing in sealing contact with said outer seal, said panel having an inwardly turned lip along its peripheral edge that closes around the other seal.

* * * * *